United States Patent [19]

Saeki et al.

[11] Patent Number: 4,985,331

[45] Date of Patent: Jan. 15, 1991

[54] MULTI-COLOR RECORDING MATERIALS

[75] Inventors: Keiso Saeki; Fumiaki Shinozaki; Yutaka Fujita, all of Shizuoka, Japan

[73] Assignee: Fuji Photo Film Co., Ltd., Kanagawa, Japan

[21] Appl. No.: 441,664

[22] Filed: Nov. 27, 1989

[30] Foreign Application Priority Data

Nov. 25, 1988 [JP] Japan ..... 63-297354

[51] Int. Cl.[5] ..... G03C 1/727; G03C 1/72

[52] U.S. Cl. ..... 430/138; 430/333; 430/337; 430/338

[58] Field of Search ..... 430/138, 333, 337, 338

[56] References Cited

U.S. PATENT DOCUMENTS

| | | | |
|---|---|---|---|
| 3,544,321 | 12/1970 | Yamada et al. | 430/337 |
| 3,708,297 | 1/1973 | Poot et al. | 430/337 |
| 3,843,384 | 10/1974 | Adachi et al. | 430/338 |
| 4,247,618 | 1/1981 | Dessauer et al. | 430/338 |
| 4,929,530 | 5/1990 | Saeki et al. | 430/138 |
| 4,942,107 | 7/1990 | Saeki et al. | 430/138 |

*Primary Examiner*—Richard L. Schilling
*Attorney, Agent, or Firm*—Sughrue, Mion, Zinn, Macpeak & Seas

[57] ABSTRACT

Multi-color recording materials where the color forming layers are established on the same side of the support are disclosed. The multi-color recording system may be either of:

(1) a two-color recording material comprising a support having provided thereon:

(a) a light-sensitive heat-sensitive color forming layer comprising (i) microcapsules containing a leuco dye which is capable of forming a color by oxidation and a photo-oxidizing agent and (ii) a reducing agent; and (b) a heat-sensitive color forming layer having a color forming temperature differing from the glass transition temperature of the microcapsule walls, and which comprises an electron donating leuco dye capable of forming a color of a hue differing from that of the light-sensitive heat-sensitive layer and an electron accepting compound capable of reacting with the electron donating lueuco dye to form a color;

(2) a multi-color recording material comprising a support having provided thereon:

(a) a light-sensitive heat-sensitive color forming layer comprising (i) at least two types of microcapsules each containing a leuco dye capable of forming a color by oxidization and a photo-oxidizing agent and (ii) a reducing agent, wherein the polymer walls of the at least two microcapsules have different glass transition temperatures from each other, and the leuco dyes contained in the microcapsules have different hues from each other; and (b) a heat-sensitive color forming layer as described above; or (3) a multi-color recording material comprising a support having provided thereon:

(a) a light-sensitive heat-sensitive color forming layer comprising (i) at least two types of microcapsules each containing a leuco dye capable of forming colors by oxidation and a photo-oxidizing agent and (ii) a reducing agent, wherein the leuco dyes contained in the microcapsules have different hues from each other, and the photo-oxidizing agents contained in the microcapsules are activated by actinic light of different wavelengths; and (b0 a heat-sensitive color forming layer as described above.

9 Claims, No Drawings

MULTI-COLOR RECORDING MATERIALS

FIELD OF THE INVENTION

This invention concerns silver salt-free light-sensitive and/or heat-sensitive recording materials with which multi-color recording is possible which can be used, for example, for obtaining color copy.

BACKGROUND OF THE INVENTION

Hitherto, silver salt photography was widely used as the most general method of obtaining multi-color images in the past because of its high sensitivity, high picture quality and ability to reproduce gradation. However, the silver salt photographic method has a disadvantage in that processing is complicated, involving processing in a development bath after imagewise exposure followed by conversion of the remaining silver halide to a silver complex salt which is soluble in water or to a silver salt which is stable in light.

The disclosure of dry type silver salt photographic light-sensitive materials in, for example, JP-A-59-48764 (the term "JP-A" as used herein means an "unexamined published Japanese Patent Application"), the disclosure of dye transfer type photographic light-sensitive materials, for example, in British Patent 249,530, and U.S. Pat. Nos. 2,020,775, 2,004,625, 2,217,544, 2,255,463 and 2,699,394, and the disclosure of silver dye-bleach type photographic light-sensitive materials, for example, in U.S. Patent 2,844,574, were made with a view to ameliorating these disadvantages.

Recording systems such as electrophotographic systems, thermal transfer systems, and ink jet systems which have a multi-color recording mechanism have been used in apparatus with recording materials in which silver salts are not used, but these systems have disadvantages in that the apparatus is large, in that recording fidelity is poor, and in that considerable effort is required to change consumables.

On the other hand, heat-sensitive recording systems do not suffer from the above mentioned disadvantages and if practical multi-color recording systems could be realized for this system they would be easy to use. There are methods in which heat-sensitive recording systems are used in which a plurality of color forming units are formed simply in sequence by increasing the thermal energy which is applied to provide color mixing and making change to render the hues impure, as disclosed, for example, in JP-B-51-19989 (corresponding to U.S. Pat. Nos. 3,895,173), JP-B-52-11231, JP-A-54-88135, JP-A-55-133991 and JP-A-55-133992 (the term "JP-B" as used herein means an "examined Japanese patent publication"). Other methods include those in which a decolorization mechanism in which a decolorizing agent operates at the same time when color forming units form colors at temperatures higher than the thermal response temperature and in which color units which have formed colors at low temperature are decolorized, as disclosed, for example, in JP-B-50-17868 (corresponding to U.S. Pat. No. 3,843,384), JP-B-51-5791, JP-B-57-14318 and JP-B-57-14319. However, there is a major problem with color hard copy of this type in that the number of colors which can be formed with these materials is small.

Recording materials in which heat-sensitive and light sensitive color forming systems, for example, are combined have been disclosed in U.S. Patent Application Ser. No. 07/174,306, JP-A-63-172681, JP-A-63-45084 (corresponding to U.S. Pat. Application Ser. No. 07/174,306) and JP-A-63-134282 (corresponding to U.S. Pat. Application Ser. No. 07/125,675) as multi-color recording materials which provide an improvement in respect of the above mentioned weaknesses. Thus, units in which a combination of diazo compound and coupler form a color forming component and/or units in which a combination of leuco dye and color developer form a color forming component are used as color forming unit layers in recording materials in which at least one color forming unit is established on either side of a transparent support and the color forming units form colors of different hues.

However, problems arise in respect of the fresh storage properties and the image densities of the recording material when a plurality of color forming unit layers is formed on the same side with recording materials of this type and so a transparent support is used and the color forming layers are formed on both sides of the support. This imposes a fundamental limitation in that non-transparent supports cannot be used for these materials, and it is inconvenient in respect of the fact that a new opaque layer has to be established during production.

SUMMARY OF THE INVENTION

The aim of the present invention is to provide multi-color recording materials (including two-color recording materials) which have excellent fresh storage properties and color densities in cases where the color forming layers are established on the same side of the support.

The aim of the invention has been realized by means of:

(1) a two-color recording material comprising a support having provided thereon:

(a) a light-sensitive heat-sensitive color forming layer comprising (i) microcapsules containing a leuco dye which is capable of forming a color by oxidation and a photo-oxidizing agent and (ii) a reducing agent; and (b) a heat-sensitive color forming layer having a color forming temperature differing from the glass transition temperature of the microcapsule walls, and which comprises an electron donating leuco dye capable of forming a color of a hue differing from that of the light-sensitive heat-sensitive layer and an electron accepting compound capable of reacting with the electron donating leuco dye to form a color;

(2) a multi-color recording material comprising a support having provided thereon:

(a) a light-sensitive heat-sensitive color forming layer comprising (i) at least two types- of microcapsules each containing a leuco dye capable of forming a color by oxidization and a photo-oxidizing agent and (ii) a reducing agent, wherein the polymer walls of the at least two microcapsules have different glass transition temperatures from each other, and the leuco dyes contained in the microcapsules have different hues from each other; and (b) a heat-sensitive color forming layer having a color forming temperature differing from the glass transition temperatures of the microcapsule walls, and which comprises an electron donating leuco dye capable of forming a different color from those of the light-sensitive heat-sensitive color forming layer and an electron accepting compound capable of reacting with the electron donating leuco dye to form a color; or (3) a multi-color recording material comprising a support having provided thereon:

(a) a light-sensitive heat-sensitive color forming layer comprising (i) at least two types of microcapsules each containing a leuco dye capable of forming colors by oxidation and a photo-oxidizing agent and (ii) a reducing agent, wherein the leuco dyes contained in the microcapsules have different hues from each other, and the photo-oxidizing agents contained in the microcapsules are activated by actinic light of different wavelengths; and (b) a heat-sensitive color forming layer having a color forming temperature differing from the glass transition temperatures of the microcapsule walls and which comprises an electron donating leuco dye capable of forming a color different from those of the light-sensitive heat-sensitive color forming layer and an electron accepting compound capable of reacting with the electron donating leuco dye to form a color.

DETAILED DESCRIPTION OF THE INVENTION

The method of manufacture of the multi-color recording materials of the present invention and the method of obtaining good multi-color images using the said materials are described below.

The preferred capsules in the light-sensitive heat-sensitive color forming layers in the present invention are capsules with which contact between substances inside and outside the capsules is prevented by the material separating action of the microcapsule walls at normal temperature, and which become permeable to materials only when they are heated above a certain temperature. The temperature at which permeability commences can be controlled freely by the appropriate selection of the material of the capsule walls, the capsule core substance, and additives. The temperature at which permeation commences in this case is referred to as the glass transition temperature of the capsule wall.

The glass transition temperature is preferably between 60° C. and 200° C. from the viewpoint of being able to achieve adequate thermal recording, and it is more preferably between 70° C. and 150° C. so as to provide a rapid response to the instantaneous heating of a thermal head.

The type of capsule wall forming agent is changed in order to control the intrinsic glass transition temperature of the capsule wall. Polyurethanes, polyureas, polyamides, polyesters and polycarbonates can be used, for example, as the wall materials which are used in the present invention, and the use of polyurethanes and polyureas for this purpose is especially preferable.

The microcapsules used in the present invention are made by emulsifying the core material which contains the light image forming substances, such as the leuco dye which can form a color by oxidation and the photo-oxidizing agent, and then forming walls of a polymeric substance around the emulsified oil droplets. In this case, the reactants which form the walls are added inside the oil droplets and/or outside the oil droplets.

In those cases where microencapsulation is carried out by polymerization of reactants from within the oil droplets for making the microcapsule walls in the present invention, it is possible to obtain the preferred capsules for recording materials which have a uniform particle size and excellent fresh storage properties in a short period of time in preparation.

The methods of microencapsulation and the raw materials and compounds used have been disclosed, for example, in U.S. Pat. Nos. 3,726,804 and 3,796,696.

For example, in the case of a polyurethane or polyurea capsule wall material, a polyisocyanate and a second compound which reacts with the polyisocyanate and forms the capsule walls (for example, a polyol or a polyamine) are mixed with the aqueous phase or in the oily liquid which is to be encapsulated and emulsified and dispersed in water, after which the temperature is raised and a polymer forming reaction occurs at the oily interface to form the microcapsule walls.

The glass transition temperature of the capsule walls can be varied over a wide range by the appropriate selection of the polyisocyanate which constitutes the first wall film forming substance and the polyol or polyamine which forms the second wall forming substance.

High boiling point oils can be used as organic solvents in which the above mentioned image forming substances are dissolved, and specific examples of such solvents include phosphate esters, phthalate esters, acrylic acid esters, methacrylic acid esters, other carboxylic acid esters, fatty acid amides, alkylated biphenyls, alkylated terphenyls, alkylated naphthalenes, diarylethanes and chlorinated paraffins.

Auxiliary solvents of low boiling point can be added to the above mentioned organic solvents in the present invention. Specific examples of such auxiliary solvents include ethyl acetate, isopropyl acetate, butyl acetate, methylene chloride and cyclohexanone.

Protective colloids and surfactants can be added to the aqueous phase in order to stabilize the emulsified oil droplets. In general terms, water-soluble high molecular materials can be used as protective colloids.

The volume average size of the microcapsules in the present invention is preferably not more than 20 μm, and more preferably not more than 4 μm, from the point of view of improved image resolution and handling properties.

The leuco dyes which can form colors by oxidation which are an essential component of the above mentioned image forming materials of the present invention are reduced forms of dyes which have one or two hydrogen atoms, color formation occurring when these hydrogen atoms are removed or, in certain cases, when electrons are added, and the dyes are formed. Such leuco dyes are substantially colorless or slightly colored so that oxidation and color formation provide a means of forming a pattern. The oxidation is achieved by the presence of at least one type of photo-oxidizing agent in the present invention. The photo-oxidizing agent is activated by irradiation with light and then reacts with the leuco dye to form a colored image against the background of the unchanged material where there has been no irradiation with light.

Leuco dyes which can form colors readily by way of the aforementioned mechanism include those disclosed, for example, in U.S. Pat. No. 3,445,234, and some are indicated below for reference.

(1) Aminotriarylmethane
(2) Aminoxanthene
(3) Aminothioxanthene
(4) Amino-9,10-dihydroacridine
(5) Aminophenoxazine
(6) Aminophenothiazine
(7) Aminodihydrophenazine
(8) Aminodiphenylmethane
(9) Leuco indamine

(10) Aminohydrocinnamic acid (cyanoethane, leuco methine)
(11) Hydrazine
(12) Leuco indigoid dyes
(13) Amino-2,3-dihydroanthraquinone
(14) Tetrahalo-p,p'-biphenol
(15) 2-(p-hydroxyphenyl)-4,5-diphenylimidazole
(16) Phenethylaniline The parent dyes are obtained by removing one hydrogen atom from the leuco forms (1) to (9), and by removing two hydrogen atoms from the leuco forms (10) to (16).

Specific examples thereof include leuco crystal violet, tris(4-diethylamino-o-tolyl)methane, bis(4-diethylamino-o-toly1,1phenylmethane, bis(4-diethylamino-o-tolyl)thienyl-2-methane, bis(2-chloro-4-diethylaminophenyl)phenylmethane, 2-(2-chlorophenyl)amino-6-N,N-dibutylamino-9(2-methoxycarbonyl)phenylxanthene, 2-N,N-dibenzylamino-6-N,N-diethylamine-9-(2-methoxycarbonyl)phenylxanthene, benzo[a]-6-N,N-diethylamino-9-(2-methoxycarbonyl)-phenylxanthene, 2-(2-chlorophenyl)-amino-6-N,N-dibutylamino-9-(2-methylphenylcarboxamido)phenylxanthene, 3,6-dimethoxy-9-(2-methoxycarbonyl)-phenylxanthene, 3,6-diethoxyethyl-9-(2-methoxycarbonyl)phenylxanthene, benzoyl leuco methylene blue, and 3,7-bis(diethylamino)phenoxazine.

Two or more types of leuco dye can be encapsulated together in the present invention.

The amount of the leuco dye in the light-sensitive heat-sensitive color forming layer of the present invention is determined in accordance with required color density of the image, and it can be determined by ordinary skilled in the art.

Chemical species which are normally inactive but which oxidize leuco dyes to their colored forms when irradiated with actinic light, such as visible light, ultraviolet, infrared or X-rays, are preferred as the photo-oxidizing agents which are used in the above mentioned image forming materials of the present invention.

Typical- photo-oxidizing agents include lophin dimers such as the 2,4,5-triarylimidazole dimers disclosed in JP-B-62-39728 (corresponding to U.S. Pat. No. 4,247,618) and JP-B-63-2099 (corresponding U.S. Pat. Nos. 4,311,783 and 4,252,887); azide compounds such as 2-azidobenzoxazole, benzoylazide and 2-azidobenzimidazole disclosed in U.S. Pat. No. 3,282,693, pyridinium compounds such as 3'-ethyl-1-methoxy-2-pyridothiacyanine perchlorate and 1-methoxy-2methyl pyridinium p-toluenesulfonate disclosed in U.S. Pat. No. 3,615,568; organic halogen compounds such as N-bromosuccinimide, tribromomethylphenylsulfone, 2-trichloromethyl5-(p-butoxystyryl)-1,3,4-oxadiazole and 2,6-ditrichloromethyl-4-(p-methoxyphenyl)triazine, and the azide polymers disclosed in *Nihon Syashin Gakkai* 1968-*nen Syunki Kenkyu Happvokai Koenyoshi-syu* (the proceedings of the 1968 annual spring conference of the Japanese Photographic Society), page 55 (1968). Of these materials, the use of the lophin dimers and organic halogen compounds is preferred, and the conjoint use of these materials is more preferable for achieving high sensitivities.

The leuco dye and photo-oxidizing agent are mixed in proportions from 10 : 1 to 1 : 10 (molar ratio), and preferably in proportions of from 2 : 1 to 1 : 2 (molar ratio) for preparing the above mentioned image forming materials of the present invention.

Stable images can be obtained precisely with image forming materials of the present invention by means of a post exposure heating process and image formation or by making an overall exposure after forming a stable latent image by means of a heating process. That is to say, the thermal recording mechanism (or fixing mechanism) of the image forming materials of the present invention involves bringing the photo-oxidizing agent and the reducing agent into contact through the microcapsule walls by heating and deactivating the oxidizing agent by the action of the reducing agent even where the photo-oxidizing agent has been activated, for example. These reducing agents act as so-called free radical capturing substances which trap the free radicals of the activated photo-oxidizing agents.

Specific examples of reducing agents include the aminophenols and hydroquinones which have a hydroxyl group on the benzene ring and at least another hydroxyl group or an amino group in another position of the benzene ring as disclosed in U.S. Pat. No. 3,042,515, the cyclic phenylhydrazides as disclosed in JP-B-62-39728 (corresponding to U.S. Pat. No. 4,247,618), guanidine derivatives, alkylenediamine derivatives and hydroxyamine derivatives. These may be used individually, or two or more of them may be used conjointly, and no limitation is imposed provided that the reducing agent has reducing properties which function in such a way that they can have an effect on the so-called oxidizing agents.

The above mentioned reducing agents can be dispersed as solids using a sand mill, for example, or they can be dissolved in an oil and emulsified and dispersed for use in the image forming materials of the present invention. In general, water-soluble high molecular weight material can be used as protective colloids when the reducing agent is dispersed as a solid and when it is emulsified and dispersed.

The amount of reducing agent used is preferably from 1 to 100 times (molar), and more preferably from 5 to 20 times (molar) based on the total molar amount of photo-oxidizing agent component.

The known sensitizing agents, ultraviolet absorbers and antioxidants can also be used as components in addition to the photo-oxidizing agents of the present invention.

Furthermore, auxiliary agents can be used freely with a view to controlling thermal recording or thermal fixing in the present invention. Such auxiliary agents may reduce the melting point cf the various components from which the system is constituted, or they may have the effect of reducing the glass transition point of the capsule walls.

Examples of these auxiliary agents include phenol compounds, alcohol compounds, amide compounds and sulfonamide compounds, and these may be included in the core materials or they may be added as dispersions outside the microcapsules.

The light-sensitive heat-sensitive layers in the present invention can be obtained by coating a dispersion of microcapsules which contain leuco dyes and photo-oxidizing agents, and reducing agents, as described above, on a support.

Binders, pigments, waxes, metal soaps or surfactants may be added to the above mentioned dispersions at this time, and the coated weight, as solid fraction, is from 3 to 30 g/m$^2$, and preferably from 5 to 20 g/m$^2$ in the recording material of the present invention.

Examples of the electron donating leuco dyes which may be used in the heat-sensitive color forming layers in the present invention include triarylmethane based compounds, diphenylmethane based compounds, xanthene based compounds, indolylphthalide based compounds, azaphthalide based compounds and spiropyran based compounds. Some specific examples of these compounds include 3,3-bis(p-dimethylaminophenyl)-6-dimethylaminophthalide, 3,3-bis(p-dimethylaminophenyl)phthalide, 3-(p-dimethylaminophenyl)-3-(1,3-dimethylindol-3-yl)phthalide and 3-(p-dimethylaminophenyl)-3(2-methylindol-3-yl)phthalide, as triarylmethane compounds; 4,4'-bis-dimethylaminobenzhyirin benzyl ether, N-halophenyl leuco auramine and N-2,4,5-trichlorophenyl leuco auramine as diphenylmethane based compounds; rhodamine B-anilinolactam, rhodamine(p-nitroanilino)lactam, 2-benzylamino-6-diethylaminofluorane, 2-anilino-6-diethylaminofluorane, 3-diethylamino-7,8-benzofluorane, 3,6-dimethoxyfluorane and 2,7-di-n-hexyl-3,6-dimethoxyfluorane as xanthene based compounds, 3,3bis(1-ethyl-2-methylindol-3-yl)phthalide, 3,3-bis-(1-octyl-2-methylindol-3-yl)phthalide, 3-(2-ethoxy-4-diethylaminophenyl)-3-(1-ethyl-2-methylindol-3-yl)phthalide and 3-(2-ethoxy-4-diethylaminophenyl)-3-(1-octyl-2-methylindol-3yl)phthalide as indolylphthalide based compounds, 3-(2-ethoxy-4-diethylaminophenyl)-3-(1-octyl-2-methylindol-3-yl)-4 (or 7)-azaphthalide and 3-(2-ethoxy-4-diethylaminophenyl)-3-(1-ethyl-2-methylindol-3-yl)-4 (or 7)-azaphthalide as azaphthalide based compounds; and 3-methylspirodinaphthopyran, 3-ethylspirodinaphthopyran, 3,3'-dichlorospirodinaphthopyran, 3-benzylspirodinaphthopyran, and 3-methylnaphtho-(3-methoxvbenzo)spiropyran as spiropyran based compounds.

The amounts of the electron donating leuco dye in the heat-sensitive color forminq layer is determined in accordance with the required color density of the image, and it can be determined by ordinary skilled in the art.

Examples of the electron accepting compounds which can be used in the heat-sensitive color forming layers in the present invention include phenol compounds, organic acids and their metal salts, and oxybenzoic acid esters. Specific examples of these compounds include 2,2-bis(4'-hydroxyphenyl)propane [bisphenol A], 2,2-bis(4'-hydroxyphenyl)pentane, 2,2-bis(4'-hydroxy-3',5'-dichlorophenyl)hexane, 1,1bis(4'-hydroxyphenyl)propane, 1,1-bis(4'-hydroxyphenyl)cyclohexane, 2,2-bis(4'-hydroxyphenyl)propane, 1,1-bis(4'-hydroxyphenyl)butane, 1,1-bis(4'-hydroxyphenyl)pentane, 1,1bis(4'-hydroxyphenyl)hexane, 1,1-bis(4'-hydroxyphenyl) heptane, 1,1-bis(4'-hydroxyphenyl)oxtane, 1,1-bis(4'-hydroxyphenyl)-2methylpentane, 1,1-bis(4'-hydroxyphenyl)-2-ethylhexane, 1,1bis(4'-hydroxyphenyl)dodecane, p-phenylphenol, 3,5-diphenylphenol and cumyl phenol as phenol based compounds; 3,5-di-α-methylbenzylsalicylic acid, 3,5-di-tert-butylsalicylic acid, 3α,α-dimethylbenzylsalicylic acid, 4-β-p-methoxyphenoxyethoxysalicylic acid, 4-β-p-methoxyphenoxyethoxysalicylic acid and the poly-valent metal salts (zinc and aluminum salts) thereof as organic acids and their salts; and benzyl p-hydroxybenzoate and 2-ethylhexyl p-hydroxybenzoate as oxybenzoic acid esters.

The proportion of electron accepting compound with respect to the electron donating leco dyes is preferably from 50 to 800% by weight, and more preferably from 100 to 500% by weight.

These electron donating leuco dyes and electron accepting compounds are each dispersed separately to a particle size of a few microns using a ball mill or a sand mill and then they are mixed together to provide a heat-sensitive color forming liquid. Furthermore, either of the components can be encapsulated. The electron donating leuco dye and the electron accepting compound are generally dispersed together in a water-soluble high molecular material solution such as a polyvinyl alcohol solution, and sensitizing agents can also be added and dispersed as required. Sensitizing agents may be added to and dispersed at the same time as either the electron donating leuco dye, the electron accepting compound or both the electron donating leuco dye and the electron accepting compound.

Binders, pigments, waxes, metal soaps or surfactants can be added to the above mentioned dispersions.

The heat-sensitive color forming layers in the present invention can be formed by coating a heat-sensitive coating liquid obtained in the above-described process on a support. The coated weight of the heat-sensitive color forming layer is preferably, calculated as solid fraction, from 2 to 10 g/m$^2$.

In the present invention, a heat-sensitive color forming layer is provided in addition to a light-sensitive heat-sensitive color forming layer and so there is an advantage in that multi-color formation can be achieved more easily that when only one type of color forming layer is used.

Suitable support materials which can be used in the recording material of the present invention include papers over the whole range from tissue paper to thick board paper, regenerated cellulose, cellulose acetate, cellulose nitrate, polyethylene terephthalate, polyethylene, polyvinyl acetate, polymethyl methacrylate and polyvinyl chloride.

Air knife coating, curtain coating, slide coating, roller coating, dip coating, wire bar coating, blade coating, gravure coating, spin coating and extrusion coating methods can be used, for example, for coating the light-sensitive heat-sensitive color forming layer and heat-sensitive color forming layer on the support, and no limitation is imposed upon the method of coating which is used.

The use of multi-color recording methods of the present invention and methods for obtaining good multi-color images are described in detail below.

In those cases in which the light-sensitive heat-sensitive color forming layer contains a plurality of microcapsules which have different glass transition points, the glass transitions points of the microcapsules which are admixed are, from the low temperature side $T_1$, $T_2$, . . $T_n$, respectively, and the hues of the colors formed by the incorporated leuco dyes are $C_1$, $C_2$, . . $C_n$, respectively, and in the case of the heat-sensitive color forming layer the color forming temperature due to the electron donating leuco dye and the electron accepting compound is $T_0$ and the hue of the color which is formed is $C_0$.

For example, printing is carried out using a heat block at a printing temperature $T_a$ such that $T_1 \leqq T_a < T_2$ and a latent image is formed, and then printing is carried out at a printing temperature $T_b$ such that $T_2 \leqq T_b < T_3$ and a latent image is formed, and this operation is repeated to form latent images in the light-sensitive heat-sensitive color forming layer, after which the material is subjected to an overall exposure to light when the hues $C_1$, $C_2$, . . $C_n$ are formed, and on printing at temperature T such that $T_0 \leqq T$ an image of hue $C_0$ is formed.

In this case it is desirable that $T_n < T_0$ in order to avoid color mixing due to unwanted color formation. Further, each difference of glass transitions points of the microcapsules between $T_1$ and $T_2$, $T_2$ and $T_3$, . . . and $T_{n-1}$ and $T_n$ is preferably 5° C. or more.

Two-color images can, of course, be obtained using the same procedure. In this case, the glass transition points of the walls of the microcapsules which are included in the light-sensitive heat-sensitive color forming layer are preferably essentially the same, but in those cases where they are different the thermal processing should be carried out at a temperature above the higher glass transition point.

Furthermore, when the color forming wavelengths (the wavelengths of the light used to form colors with the microencapsulated leuco dyes) are different, $\lambda_1$, $\lambda_2$, ... $\lambda_n$, it is possible to form each hue independently and this is preferred. Thus, the hue $C_1$ is formed with exposure to light of wavelength $\lambda_1$, the hue $C_2$ is formed with exposure to light of wavelength $\lambda_2$, and after repeating such a process the material is subjected to a temperature above the glass transition point of the microcapsules but below the color forming temperature of the heat-sensitive color forming layer, and then an image is drawn at a temperature above the color forming temperature of the heat-sensitive color forming layer and a multi-color image is obtained In this case, the multi-color image can be obtained without use of microcapsules which have different glass transition points.

In this case, each difference in the activating wavelengths of the photo-oxidizing agents between $\lambda_1$ and $\lambda_2$, $\lambda_2$ and $\lambda_3$, ... and $\lambda_{n-1}$ is preferably 20 nm or more, more preferably 50 nm or more.

Photo-oxidizing agents which have different activating wavelengths can also be contained in microcapsules which have different glass transition points and in this case printing is carried out at a printing temperature $T_a$ such that $T_1 \leqq T_a < T_2$ and a latent image is formed, after which the material is exposed to light of wavelength $\lambda_1$ and an image of hue $C_1$ is obtained, and then printing is carried out at printing temperature $T_b$ such that $T_2 \leqq T_b < T_3$ and a latent image is formed and an image of hue $C_2$ is obtained by subsequent exposure to light of wavelength $\lambda_2$, and a multi-colored image can be obtained in this way.

The light-sensitive heat-sensitive color forming layer and the heat-sensitive color forming layer of the present invention are preferably formed as separate layers on the support from the points of view of the storage properties of the recording materials and the color forming density for example, and it is also preferable that these layers should be formed on the same side of the support in order to simplify the recording apparatus.

Although it is not particularly limited, the heat-sensitive color forming layer of the present invention is preferably provided nearer than the light-sensitive heat-sensitive color forming layer to the support in the recording material of the present invention.

Further, a surface protective layer, an interlayer, a back coating layer and so on may be provided in the recording material of the present invention.

Any convenient light source can be used to activate the photo-oxidizing agents and to form the leuco dye images in the present invention. Useful light sources include fluorescent lamps, mercury lamps, metal halide lamps, xenon lamps and tungsten lamps The multi-col-or recording material of the present invention have excellent fresh storage properties and color forming densities and, moreover, the recording layer consists of just two layers and so the manufacturing process is very simple. Moreover, in cases where the two said layers are formed on the same side of the support, there is a further advantage in that the recording apparatus can be simplified.

Illustrative examples of the invention are described below, but the invention is not limited by these examples. Moreover, in the examples the term "parts" relating to amounts added signifies "parts by weight".

EXAMPLE 1

Preparation of Capsule Liquid A

| | |
|---|---|
| Benzo[a]-6-N,N-diethylamino-9-(2-methoxycarbonyl)phenylxanthene | 2 parts |
| 2,2'-Bis(o-chlorophenyl)-4,4',5,5'-tetraphenylimidazole | 2 parts |
| Tribromomethylphenylsulfone | 0.4 part |
| 2,5-Di-tert-octylhydroquinone | 0.6 part |
| p-Toluenesulfonamide | 0.2 part |
| Xylylenediisocyanate/trimethylolpropane adduct, 75% by weight ethyl acetate solution | 20 parts |

were added to a mixed solvent comprising:

| | |
|---|---|
| Ethyl acetate | 16 parts |
| Di-isopropylnaphthalene | 18 parts |

and a solution was obtained. This solution was added to 54 parts of a 6% by weight aqueous solution of carboxy modified polyvinyl alcohol and emulsified and dispersed at 20° C. to provide an emulsion of average particle diameter of 1 μm. Sixty eight parts of water was added to the emulsion so obtained and the mixture was stirred continuously at 40° C. for a period of 3 hours. The mixture was then cooled to room temperature and filtered to provide capsule liquid A.

The glass transition point of the capsule walls was 80° C., the color forming wavelength with the leuco dye and the photo-oxidizing agent was 365 nm, and the hue of the color which was formed was magenta.

Preparation of Capsule Liquid B

| | |
|---|---|
| Tris(4-diethylamino-o-tolyl)methane | 2 parts |
| 2,2'-Bis(o-chlorophenyl,)-4,4',5,5'-tetraphenylimidazole | 2 parts |
| 2,6-di-trichloromethyl-4-(p-methoxyphenyl)-triazine | 0.8 part |
| 2-(5'-methyl-2'-hydroxyphenyl)benzotriazole | 4 parts |
| Hexamethylenediisocyanate/trimethylolpropane adduct, 75% by weight ethyl acetate solution | 20 parts |

were added to a mixed solvent comprising:

| | |
|---|---|
| Ethyl acetate | 16 parts |
| Di-isopropylnaphthalene | 18 parts |

and a solution was obtained This solution was added to 54 parts of a 6% by weight aqueous solution of carboxy modified polyvinyl alcohol and emulsified and dispersed at 20° C. to provide an emulsion of average particle diameter of 1 μm. Sixty eight parts of water was added to the emulsion so obtained and the mixture was stirred continuously at 40° C. for a period of 3 hours. The mixture was then cooled to room temperature and filtered to provide capsule liquid B.

The glass transition point of the capsule walls was 70° C., the color forming wavelength with the leuco dye and the photo-oxidizing agent was 435 nm, and the hue of the color which was formed was cyan.

Preparation of the Reducino Agent Dispersion

Thirty parts of 1-phenylpyrazolidin-3-one (phenidone A) was added to 150 parts of a 4% by weight aqueous solution of carboxy modified polyvinyl alcohol and dispersed in a transverse type sand mill to provide a liquid phenidone A dispersion of average particle size 1 μm, as the reducing agent dispersion.

Preparation of the Light-sensitive Heat-sensitive Color Forming Liquid

A coating liquid of which the composition is indicated below was prepared to provide a light-sensitive heat-sensitive color forming liquid.

| | |
|---|---|
| The above mentioned capsule liquid A | 6.8 parts |
| The above mentioned capsule liquid B | 6.8 parts |
| The above mentioned reducing agent liquid dispersion | 6.0 parts |
| 30% Epoxidized polyamide resin (FL-71, made by Toho Kagaku Co., Ltd.) | 0.4 part |

Preparation of the Heat-sensitive Color Forming Liquid

Twenty grams of 2,7-di-n-hexyl-3,6-dimethoxyfluorane was dispersed in a ball mill for a whole day together with 100 grams of a 5% aqueous solution of polyvinyl alcohol (PVA 105, trade name, made by the Kurare Co., Ltd.) and a color former liquid dispersion of average particle size not more than 3 μm was obtained.

Next, 20 grams of bisphenol A was dispersed for a whole day in a ball mill together with 100 grams of a 5% aqueous solution of polyvinyl alcohol (PVA 105, trade name, made by the Kurare Co., Ltd.) and a developer liquid dispersion of average particle size not more than 3 μm was obtained.

Moreover, 80 grams of calcium carbonate (Unibar 70, trade name, made by Sh-raishii Kogyo Co., Ltd.) was dispersed in a homogenizer together with 160 grams of 0.5 % aqueous solution of sodium hexametaphosphate and a pigment liquid dispersion was obtained.

Each of the dispersions prepared in the ways described above were mixed together in the proportions 5 grams of the color former liquid dispersion, 10 grams of the developer liquid dispersion and 15 grams of the pigment liquid dispersion, 3 grams of a 21% zinc stearate liquid dispersion was added and a heat-sensitive color forming liquid was obtained.

The temperature at which color formation started with this color forming agent and developer was 90° C.

Formation of the Recording Sheet

The heat-sensitive color forming liquid and the light-sensitive heat-sensitive color forming liquid were coated sequentially with a coating rod onto top quality paper (meter basis weight: 76 g/m$^2$) in such a way that the coated weights as solid fractions were 8 g/m$^2$ and 12 g/m$^2$, respectively, and dried at 40° C. to provide a multi-color recording material of the present invention.

The recording sheet so obtained was heated to 70° C. for one second using a heat block at a plurality of random positions, after which the sheet was subjected to a 5 second over-all exposure with a Jetlight (an ultra-high pressure mercury lamp, made by the ORC Co., Ltd.) using a filter which cut off light of wavelength less than 400 nm and a cyan colored image was obtained.

Moreover, the material was then heated to 80° C. for 1 second using a heat block in the same way as described above and subjected to a 5 second over-all exposure with a Jetlight using a filter which cut off light of wavelength above 400 nm and a magenta color was formed in the light-sensitive heat-sensitive color forming layer.

Finally, the material was heated to 100° C. for 1 second using a heat block in the same way as described above and a yellow colored image was obtained.

The results obtained showed that bright cyan, magenta and yellow, and blue (cyan+magenta), green (cyan+yellow), red (magenta+yellow) and black (cyan+magenta+yellow), colored images could be obtained.

EXAMPLE 2

Capsule liquid C of which the composition is indicated below was prepared.

Preparation of Capsule Liquid C

| | |
|---|---|
| Tris(4-diethylamino-o-tolyl)methane | 2 parts |
| 2,2'-Bis(o-chlorophenyl)-4,4',5,5'-tetraphenylimidazole | 2 parts |
| 2,6-di-trichloromethyl-4-(p-methoxyphenyl)-triazine | 0.8 part |
| 2-(5'-methyl-2'-hydroxyphenyl)benzotriazole | 4 parts |
| p-Toluenesulfonamide | 0.2 part |
| Xylylenediisocynate/trimethylolpropane adduct, 75% by weight ethyl acetate solution | 20 parts |

were added to a mixed solvent comprising:

| | |
|---|---|
| Ethyl acetate | 16 parts |
| Di-isopropylnaphthalene | 18 parts |

and a solution was obtained. This solution was added to 54 parts of a 6% by weight aqueous solution of carboxy modified polyvinyl alcohol and emulsified and dispersed at 20° C. to provide an emulsion of average particle diameter of 1 μm. Sixty eight parts of water was added to the emulsion so obtained and the mixture was stirred continuously at 40° C. for a period of 3 hours. The mixture was then cooled to room temperature and filtered to provide capsule liquid C.

The glass transition point of the capsule walls was 80° C., the color forming wavelength with the leuco dye and the photo-oxidizing agent was 435 nm, and the hue of the color which was formed was cyan.

A recording sheet was then obtained in the same way as in Example 1 except that capsule liquid C was used in place of the capsule liquid B used in Example 1.

The sheet so obtained was exposed imagewise for 5 seconds with a Jetlight (an ultra-high pressure mercury lamp, made by the ORC Co., Ltd.) using a filter which cut off light of less than 400 nm and a cyan colored image was obtained.

Next, the material was exposed imagewise in the same way using a filter which cut off light above 400 nm and a magenta colored image was obtained.

The recording sheet which had these colored image was then passed between heated rollers at 80° C. at a feed rate of 1 cm/sec.

Finally, the material was heated for 1 second at 100° C. in random positions using a hot block and a yellow colored image was obtained.

The results obtained showed that clear cyan, magenta and yellow, and also blue (cyan+magenta), green (cyan+yellow), red (magenta+yellow) and black (cyan+magenta+yellow), colored images could be obtained.

While the invention has been described in detail and with reference to specific examples thereof, it will be apparent to one skilled in the art that various changes and modifications can be made therein without departing from the spirit and scope thereof.

What is claimed is:

1. A two color recording material comprising a support having provided thereon:

(a) a light-sensitive heat-sensitive color forming layer comprising (i) microcapsules containing a leuco dye which is capable of forming a color by oxidation and a photo-oxidizing agent and (ii) a reducing agent; and (b) a heat-sensitive color forming layer having a color forming temperature differing from the glass transition temperature of said microcapsule walls, and which comprises an electron donating leuco dye capable of forming a color of a hue differing from that of said light-sensitive heat-sensitive layer and an electron accepting compound capable of reacting with said electron donating leuco dye to form a color.

2. The two-color recording material as claimed in claim 1, wherein said light-sensitive heat-sensitive color forming layer and said heat-sensitive color forming layer are provided on the same side of the support.

3. The two-color recording material as claimed in claim 1, wherein said color forming temperature of said heat-sensitive color forming layer is higher than the glass transition point of said polymer walls of microcapsules.

4. A multi-color recording material comprising a support having provided thereon:

(a) a light-sensitive heat-sensitive color forming layer comprising (i) at least two types of microcapsule each containing a leuco dye capable of forming a color by oxidization and a photo-oxidizing agent and (ii) a reducing agent, wherein the polymer walls of said at least two microcapsules have different glass transition temperatures from each other, and said leuco dyes contained in said microcapsules have different hues from each other; and (b) a heat-sensitive color forming layer having a color forming temperature differing from said glass transition temperatures of said microcapsule walls and which comprises an electron donating leuco dye capable of forming a different color from those of said light-sensitive heat-sensitive color forming layer and an electron accepting compound which is capable of reacting with said electron donating leuco dye to form a color.

5. The multi-color recording material as claimed in claim 4, wherein said light-sensitive heat-sensitive color forming layer and said heat-sensitive color forming layer are provided on the same side of the support.

6. The multi-color recording material as claimed in claim 4, wherein said color forming temperature of said heat-sensitive color forming layer is higher than the glass transition point of said polymer walls of microcapsules.

7. A multi-color recording material comprising a support having provided thereon:

(a) a light-sensitive heat-sensitive color forming layer comprising (i) at least two types of microcapsules each containing a leuco dye capable of forming colors by oxidation and a photo-oxidizing agent and (ii) a reducing agent, wherein said leuco dyes contained in said microcapsules have different hues from each other, and said photo-oxidizing agents contained in said microcapsules are activated by actinic light of different wavelengths; and (b) a heat sensitive color forming layer having a color forming temperature differing from said glass transition temperatures of said microcapsule walls and which comprises an electron donating leuco dye capable of forming a color different from those of said light-sensitive heat-sensitive color forming layer and an electron accepting compound capable of reacting with said electron donating leuco dye to form a color.

8. The multi-color recording material as claimed in claim 7, wherein said light-sensitive heat-sensitive color forming layer and said heat-sensitive color forming layer are provided on the same side of the support.

9. The multi-color recording material as claimed in claim 7, wherein said color forming temperature of said heat-sensitive color forming layer is higher than the glass transition point of said polymer walls of microcapsules.

* * * * *